US007035573B2

(12) United States Patent
Yamaguchi et al.

(10) Patent No.: US 7,035,573 B2
(45) Date of Patent: Apr. 25, 2006

(54) DEVELOPING APPARATUS HAVING DEVELOPER CARRYING SCREW WITH A PLURALITY OF INCLINATION ANGLES

(75) Inventors: Seiji Yamaguchi, Shizuoka (JP); Masahide Kinoshita, Shizuoka (JP); Atsushi Numagami, Kanagawa (JP); Kazunari Murayama, Shizuoka (JP); Takahito Ueno, Shizuoka (JP); Masao Uyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/664,960

(22) Filed: Sep. 22, 2003

(65) Prior Publication Data

US 2004/0057755 A1 Mar. 25, 2004

(30) Foreign Application Priority Data

Sep. 24, 2002 (JP) ..... 2002-277235
Oct. 30, 2002 (JP) ..... 2002-315873

(51) Int. Cl.
*G03G 15/08* (2006.01)

(52) U.S. Cl. ..... 399/256
(58) Field of Classification Search ..... 399/256
See application file for complete search history.

(56) References Cited

U.S. PATENT DOCUMENTS 5,204,721 A * 4/1993 Sharpe ..... 399/256
5,614,994 A * 3/1997 Kreiter ..... 399/256
5,835,828 A * 11/1998 Jyoroku ..... 399/256
5,963,766 A * 10/1999 Okuno et al. ..... 399/256
6,021,291 A 2/2000 Karakama et al. ..... 399/104
6,324,369 B1 11/2001 Yamaguchi et al. ..... 399/254
6,337,957 B1 * 1/2002 Tamaki et al. ..... 399/29
6,381,419 B1 4/2002 Kinoshita et al. ..... 399/27
6,381,431 B1 4/2002 Kinoshita et al. ..... 399/175
6,421,516 B1 7/2002 Kinoshita et al. ..... 399/254
6,463,242 B1 10/2002 Kojima et al. ..... 399/258

(Continued)

FOREIGN PATENT DOCUMENTS

JP 3-42692 2/1991
JP 4-174471 6/1992
JP 09325609 A * 12/1997
JP 10-69154 3/1998
JP 10-221937 8/1998
JP 2002-31940 1/2002
JP 2002-162815 6/2002
JP 2002278270 A * 9/2002

OTHER PUBLICATIONS

Computer translation of cited reference JP 10–221937A.*
Patent Abstracts of Japan, Kokai No. 10–221937, Aug. 21, 1998.
Patent Abstracts of Japan Publication No. 2002–278270, Sep. 27, 2002.
Computer generated, English–language Translation of JP 2002–278270.

*Primary Examiner*—Quana Grainger
(74) *Attorney, Agent, or Firm*—Fitzpatrick, Cella, Harper & Scinto

(57) ABSTRACT

An object of the present invention is to provide a developing apparatus capable of reducing unevenness of density of an image in a longitudinal direction of a photosensitive member. For this purpose, in the present invention, a developing apparatus includes a developer bearing member, and a developer carrying screw placed adjacently to the developer bearing member in parallel with the developer bearing member, and an inclination angle of "a carrying surface facing in a developer carrying direction of a spiral blade of the developer carrying screw" to a shaft of the developer carrying screw is equal to or less than 60 degrees.

18 Claims, 11 Drawing Sheets

U.S. PATENT DOCUMENTS 6,574,442 B1 * 6/2003 Kibune ..... 399/49
6,577,834 B1 6/2003 Suzuki ..... 399/254
6,587,660 B1 7/2003 Ueno et al. ..... 399/252
6,687,474 B1 * 2/2004 Yamada et al. ..... 399/106
2002/0025173 A1 2/2002 Isobe et al. ..... 399/12
2002/0146252 A1 10/2002 Yamaguchi ..... 399/30
2003/0021609 A1 1/2003 Yamaguchi et al. ..... 399/27
2003/0123889 A1 7/2003 Isobe et al. ..... 399/27

* cited by examiner

FIG. 2A
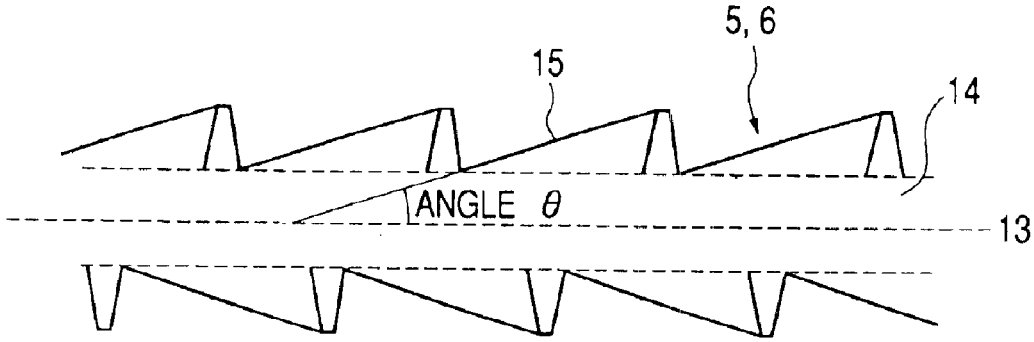
FIG. 2B
| ANGLE θ | 75 | 60 | 45 | 30 |
|---|---|---|---|---|
| UNEVENNESS OF SCREW PITCH | × | Δ | ○Δ | ○ |
| DEVELOPER CARRYING AMOUNT | ○ | Δ | Δ× | × |
FIG. 2C
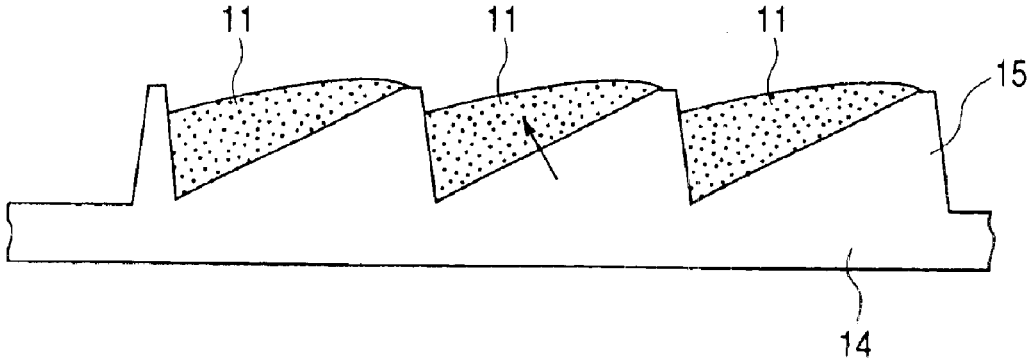

FIG. 3A
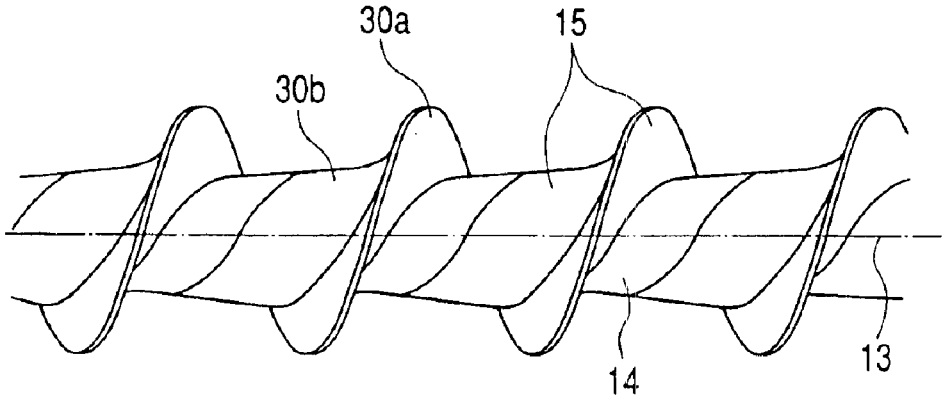
FIG. 3B
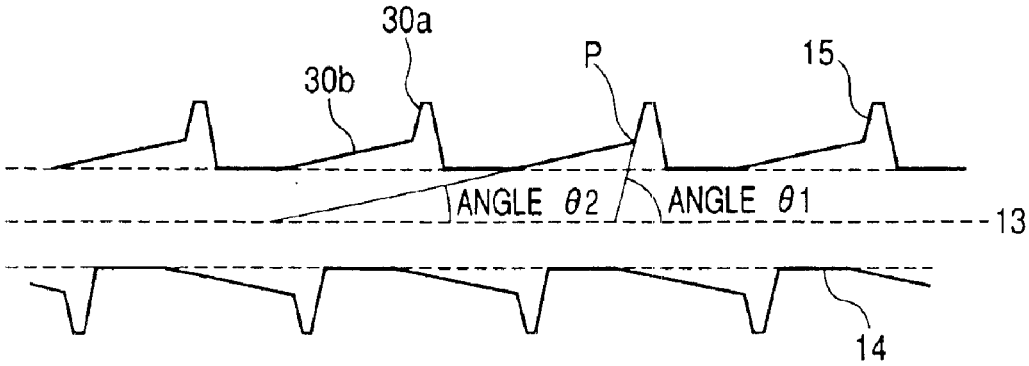
FIG. 3C
| ANGLE θ2 | 40 | 25 | 10 |
|---|---|---|---|
| UNEVENNESS OF SCREW PITCH | Δ | Δ○ | ○ |
| DEVELOPER CARRYING AMOUNT | ○ | ○ | ○ |

FIG. 9
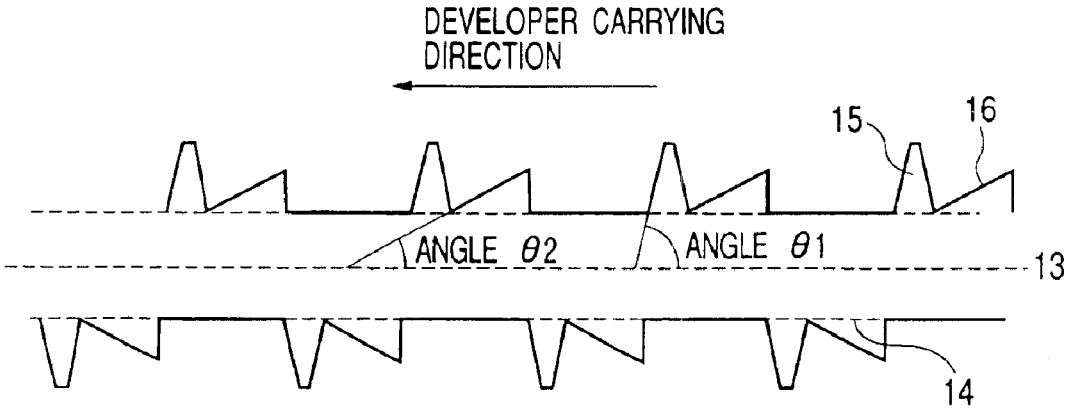
FIG. 10
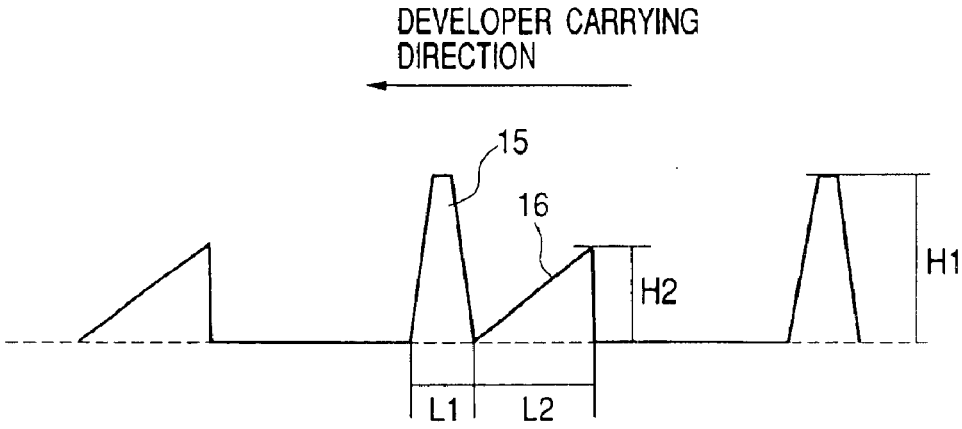
FIG. 11
| H2 mm | 0 | 1 | 1.5 | 2 | 3 | 4 |
|---|---|---|---|---|---|---|
| UNEVENNESS OF SCREW PITCH | × | ○ Δ | ○ | ○ | Δ | × |

FIG. 15
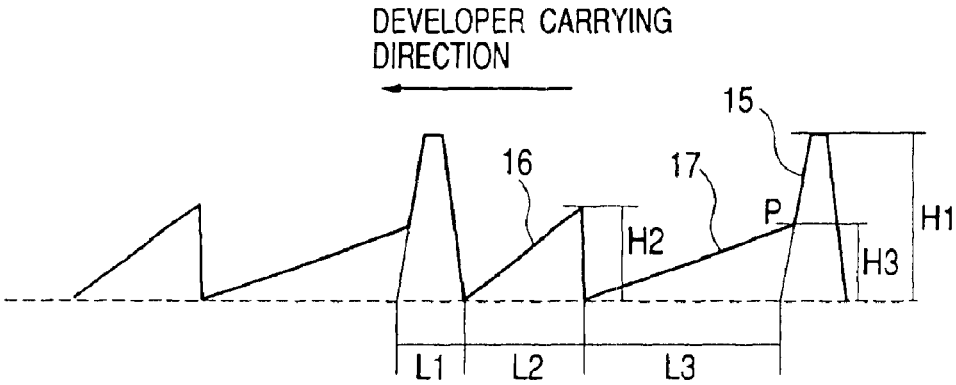
FIG. 16
| H3 mm | 0 | 1 | 1.5 | 2 | 3 |
|---|---|---|---|---|---|
| UNEVENNESS OF SCREW PITCH | × | ○ Δ | ○ | ○ | Δ |
| DEVELOPER CARRYING AMOUNT | ○ | ○ | ○ | Δ | × |
FIG. 17
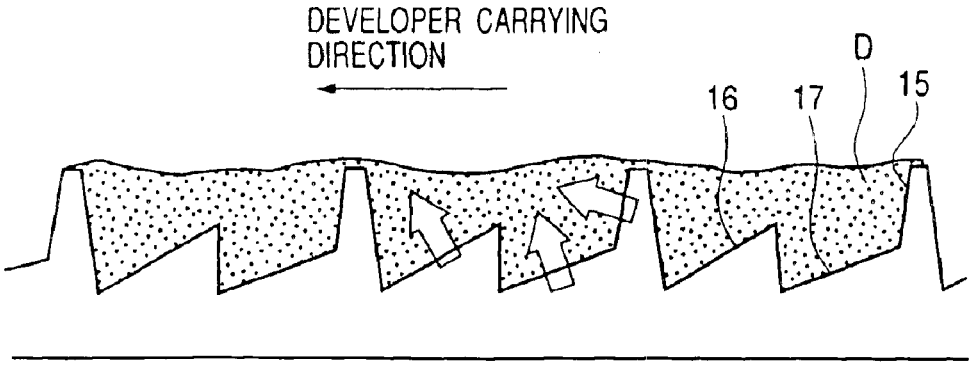

DEVELOPING APPARATUS HAVING DEVELOPER CARRYING SCREW WITH A PLURALITY OF INCLINATION ANGLES

BACKGROUND OF THE INVENTION

1. Field of the Invention

The present invention relates to a developing device mounted on an image forming apparatus such as a copying machine and a printer, and particularly to a developing apparatus having a developer carrying screw.

2. Related Background Art

As a developing apparatus mounted on "an image forming apparatus using an electrophotographic technology", developing apparatuses using two-component developers with very good electrostatic property are widely used conventionally. FIGS. 7A and 7B show a construction of an ordinary developing apparatus using a two-component developer, FIG. 7A is a sectional view, and FIG. 7B is an explanatory plane view.

Reference numeral 10 denotes a developer container, which houses a developer 11 constituted of a toner and a carrier. An opening is provided at a region of the developer container 10, which is in close vicinity to and opposes to a photosensitive member drum 1, and a developing sleeve 2, which is a developer carrier, is provided at the opening. The developing sleeve 2 is a hollow non-magnetic metal sleeve, which contains a magnet roller 3 being magnetic field generating means therein.

Reference numerals 5 and 6 denote developer carrying members, which are screws each with blade members being wound around a center shaft in a cylindrical shape at fixed pitches. A first screw 5 and a second screw 6 are placed substantially in parallel, and an inner wall 7 is provided between the first screw 5 and the second screw 6 to partition them so that the developer does not move between them.

Inner walls do not exist at both end portions in a longitudinal direction of the developer container 10 so that the developer can move between the first screw and the second screw. The first screw 5 and the second screw 6 carries the developer in opposite directions from each other, and therefore when the screws are rotated, the developer circulates inside without being interrupted as shown by the arrows in FIG. 7B.

The developer which is being carried by the first screw 5 is carried on a surface of the developing sleeve by a magnetic force of the magnet roller 3, and is carried toward the opening of the developer container 10 with the rotation of the developing sleeve 2. Reference numeral 4 denotes a developer regulating member, and by regulating the developer on the developing sleeve 2 to a proper amount, a uniform coat of the developer is formed on the developing sleeve 2. A magnetic brush of the developer carried by the developing sleeve 2 contacts the rotating photosensitive member drum 1 at a developing portion, and an electrostatic latent image is developed on the photosensitive member drum 1.

FIGS. 8A, 8B and 8C show the screw for carrying the developer, FIG. 8A is an outline view of the screw, FIG. 8B is a sectional view cut along a plane passing through a rotation centerline of the screw, and FIG. 8C is an explanatory view of a developer carrying state. Reference numeral 13 denotes a rotation centerline, reference numeral 14 denotes a rotary shaft, and reference numeral 15 denotes a blade wound thereabout in a spiral form. If an angle formed by the blade 15 with respect to the rotation centerline facing in the developer carrying direction is assumed to be θ, the angle θ is usually set at about 70 to 80 degrees in consideration of a draft angle or the like of a forming die because the carrying force-for the developer becomes larger when the angle θ becomes closer to the perpendicular.

However, such a problem as will be explained below sometimes occurs to the conventional construction.

As shown in FIG. 8C, following the rotation of the screw, the developer 11 receives a pushing force in a traveling direction by the blade 15, and therefore the developer 11 leans to a side of a surface of the blade 15 in the carrying direction. Then, the amount of the developer 11 decreases as it is away from the blade 15, and therefore it is carried in each of blade portions in the state as shown in FIG. 8C. Consequently, as viewed the longitudinal distribution of the developer 11 a portion with a large amount of the developer 11 and a portion with a small amount thereof are formed in accordance with the pitch of the blade 15.

Since the developer moves onto the surface of the developing sleeve 2 from the screw 5, and further moves to an opposing portion to the photosensitive member 1 following the rotation of the developing sleeve 2, unevenness of distribution of the developer by the aforementioned screw 5 causes unevenness of distribution of the developer on the surface of the developing sleeve 2, which results in unevenness of density of an image in a longitudinal direction of the photosensitive member 1 (this poor image will be called "unevenness of the screw pitch" hereinafter).

Such unevenness of the screw pitch easily occurs especially when the developing sleeve 2 and the developer carrying screw 5 are designed to be placed close to each other to make the apparatus compact.

Even if each of constructions such as placement relationship of the developing sleeve 2 and the screws, magnetic relationship of the magnet inside the developing sleeve, and a regulation state of the developer layer thickness by the regulating member 4 is optimized so that the unevenness of the screw pitch does not appear on the image, it is difficult to prevent the unevenness of the screw pitch completely, as long as the developer carried by the screw becomes uneven in distribution at the screw blade pitches.

Further, the developing apparatus with use of the two-component developer having the toner and the carrier varies in the toner density of the developer in accordance with the balance of the toner consumption and replenishment, and therefore the amount of the developer sometimes increases and decreases while the apparatus is operating. Especially, in the state in which the amount of the toner in the developing apparatus is small, it is a task of extreme difficulty to prevent the unevenness of the screw pitch completely.

SUMMARY OF THE INVENTION

The present invention is made in view of the aforementioned problem, and its object is to provide a developing apparatus capable of reducing inconsistencies in density of an image in a longitudinal direction of a photosensitive member.

Another object of the present invention is to provide a developing apparatus capable of reducing unevenness of distribution of an amount of a developer in a longitudinal direction of a screw for carrying the developer.

Still another object of the present invention is to provide a compact developing apparatus from which unevenness of screw pitch hardly appears.

Yet another object of the present invention is to provide a developing apparatus having a developer bearing member, and a developer carrying screw placed adjacently to the developer bearing member in parallel with the developer bearing member, in which an inclination angle of "a carrying surface facing in a developer carrying direction of a spiral blade of the developer carrying screw" to a shaft of the developer carrying screw is equal to or less than 60 degrees.

Another object of the present invention is to provide a developing apparatus having a developer bearing member, and a developer carrying screw placed in parallel with the developer bearing member, in which an inclination angle of "a carrying surface facing in a developer carrying direction of a spiral blade of the developer carrying screw" to a shaft of the developer carrying screw is smaller than an inclination angle of a surface at an opposite side from the carrying surface of the blade.

Still another object of the present invention is to provide a developing apparatus having a developer bearing member, and a developer carrying screw placed in parallel with the developer bearing member, in which a spiral blade of the developer carrying screw faces in a developer carrying direction, and has a plurality of carrying surfaces having different inclination angles with respect to a shaft of the developer carrying screw.

Yet another object of the present invention is to provide a developing apparatus having a developer bearing member, and a developer carrying screw placed in parallel with the developer bearing member, in which a base portion of a carrying surface facing in a developer carrying direction, of a spiral blade of the developer carrying screw has a curved surface portion, and a base portion of a surface at an opposite side from the carrying surface is a non-curved surface.

Another object of the present invention is to provide a developing apparatus having a developer bearing member, and a developer carrying screw placed in parallel with the developer bearing member, in which the developer carrying screw has a plurality of spiral blades having different inclination angles of carrying surfaces facing in the developer carrying direction.

Further objects of the present invention will become apparent by reading the following detailed explanation with reference to the accompanying drawings.

BRIEF DESCRIPTION OF THE DRAWINGS

FIGS. 2A, 2B and 2C show a screw for carrying a developer, FIG. 2A is a sectional view cut by a plane passing through a rotation centerline of the screw, FIG. 2B is a table showing results of performing a developer carrying experiment by changing a blade angle (inclination angle), and FIG. 2C is an explanatory view of a state of the developer carried by the screw;

FIGS. 3A, 3B and 3C show a screw of a developing apparatus according to a second embodiment, FIG. 3A is an outline view of the screw, FIG. 3B is a sectional view cut by a plane passing through a rotation centerline of the screw, and FIG. 3C is a table showing results of performing a developer carrying experiment by changing a blade angle (inclination angle);

FIG. 7A is a sectional view, and FIG. 7B is an explanatory plane view;

FIG. 8A is an outline view of the screw, FIG. 8B is a sectional view cut by a plane passing through a rotation centerline of the screw, and FIG. 8C is an explanatory view of a developer carrying state;

FIG. 9 is a sectional view cut by a plane passing through a rotation centerline of a screw of a third embodiment;

FIG. 10 is a sectional view cut by the plane passing through the rotation centerline of the screw of the third embodiment, and is an enlarged view of blade portions;

FIG. 11 is a table showing results of an image forming test with height of a bulk-increasing spiral blade 16 as a parameter;

FIG. 15 is a sectional view cut by the plane passing through the rotation centerline of the screw of the fourth embodiment, and is an enlarged view of blade portions;

FIG. 16 is a view showing results of an image forming test with height of a bulk-increasing spiral blade 17 as a parameter;

FIG. 17 is a view explaining an effect of the fourth embodiment; and

DETAILED DESCRIPTION OF THE PREFERRED EMBODIMENTS (First Embodiment)

Figure 1:
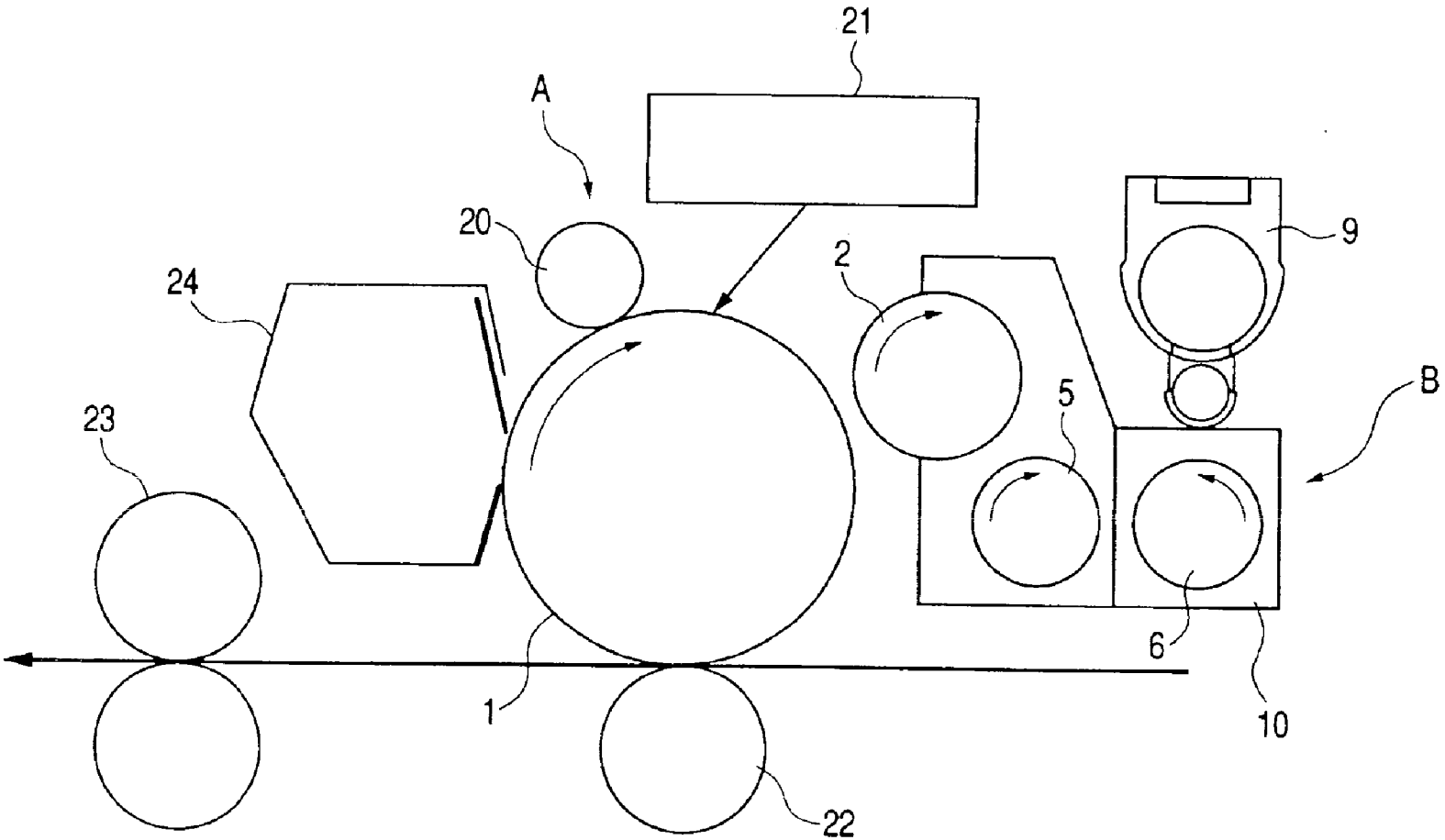
FIG. 1 is a schematic sectional view of an entire image forming apparatus.

Next, an image forming apparatus including a developing apparatus according to a first embodiment of the present invention will be explained with reference to FIG. 1, FIGS. 2A, 2B and 2C. FIG. 1 is a schematic sectional view of an entire image forming apparatus, FIGS. 2A, 2B and 2C show a screw for carrying a developer, FIG. 2A is a sectional view cut by a plane passing through a rotation centerline of the screw, FIG. 2B is a table showing results of performing a developer carrying experiment by changing a blade angle, and FIG. 2C is an explanatory view of a state of the developer carried by the screw.

(Entire Construction of the Image Forming Apparatus)

First, the entire construction of an image forming apparatus A will be briefly explained with reference to FIG. 1. In FIG. 1, reference numeral 1 denotes a rotatable photosensitive member drum which is a latent image bearer, around which, an electrifier 20 for electrifying a surface of the photosensitive member drum 1, an exposing apparatus 21 for performing selective exposure to the electrified photosensitive member drum 1 to form a latent image, a developing apparatus B for developing the aforesaid latent image by the developer to make it a visible image, a transferring apparatus 22 for transferring the toner image made visible to a transferring material carried by transferring means, and a cleaning apparatus 24 for removing the developer remaining on the photosensitive member drum 1 after the toner is transferred to the transferring material are placed in the order in the rotational direction of the photosensitive member drum 1.

The transferring material to which the toner image is transferred is heated and fixed by a fixing apparatus 23, and thereafter, it is discharged outside the apparatus.

(Developing Apparatus)

Next, the developing apparatus B will be explained. The developing apparatus B includes a developer container 10 for housing the developer, and the developer container 10 houses the developer which is a mixture of toner particles and magnetic carrier particles. A toner replenishing apparatus 9 for replenishing toner to the developing apparatus B is placed above the developer container 10. The aforesaid developer container 10 houses the developer which is the mixture of the toner particles and the magnetic carrier particles.

As the toner, a known one which is made by adding a coloring agent, an electrification control agent and the like are added to a binder resin can be used, and in this embodiment, the one with an average volume particle diameter of 5 to 15 μm is used. Meanwhile, as the magnetic carrier, a ferrite carrier, the one coated with resin coating and the like are preferably used, and the one with the average particle diameter of 15 to 70 μm is preferable.

Figure 7A:
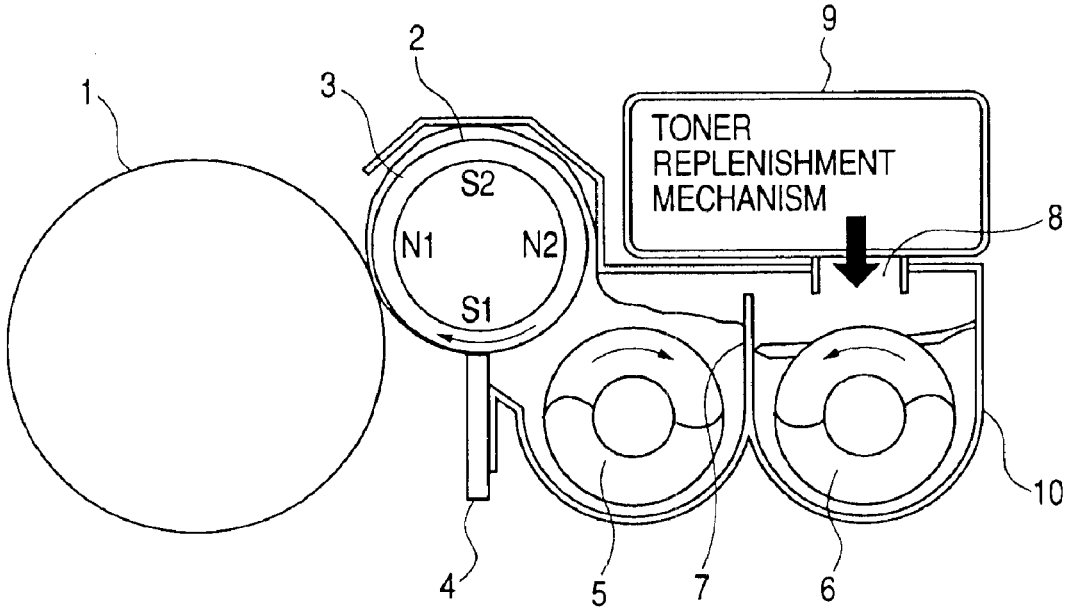
FIGS. 7A and 7B show a construction of an ordinary developing apparatus using a two-component developer.
Figure 7B:
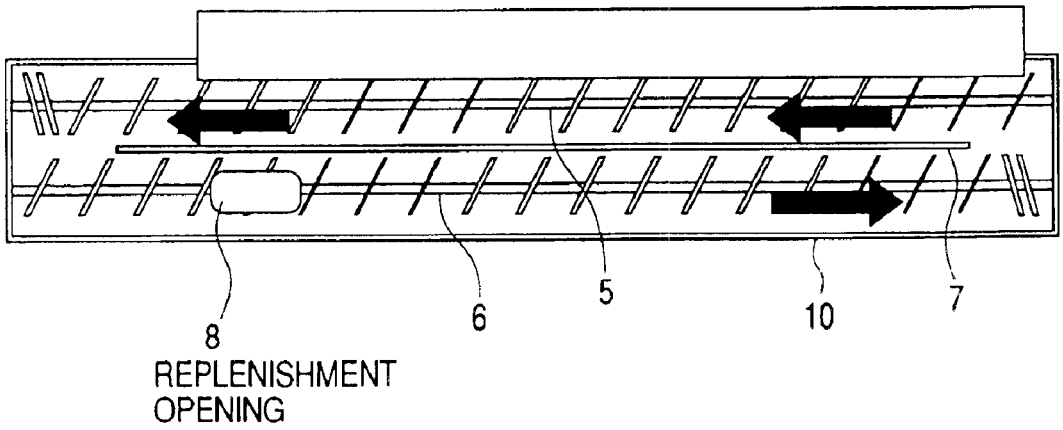
Figure 8A:
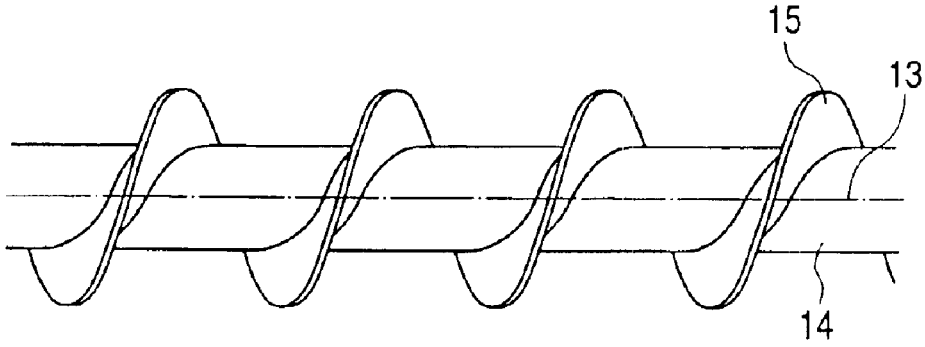
FIGS. 8A, 8B and 8C show a screw for carrying the developer.
Figure 8B:
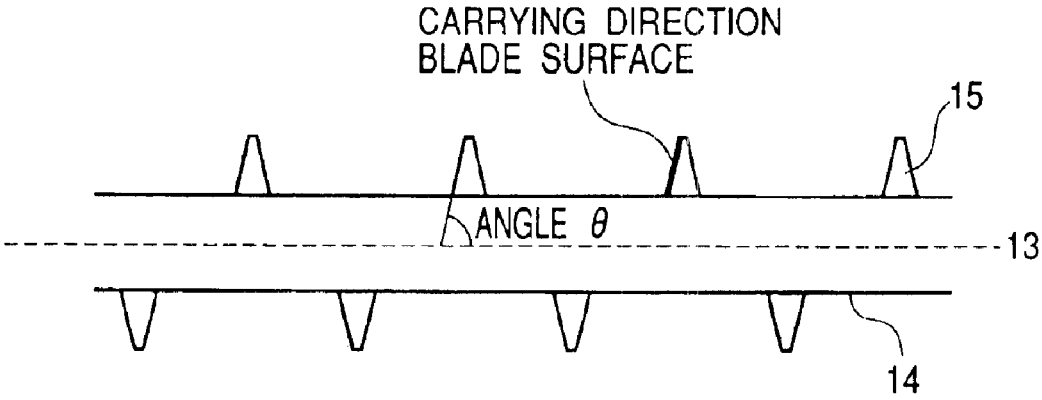
Figure 8C:
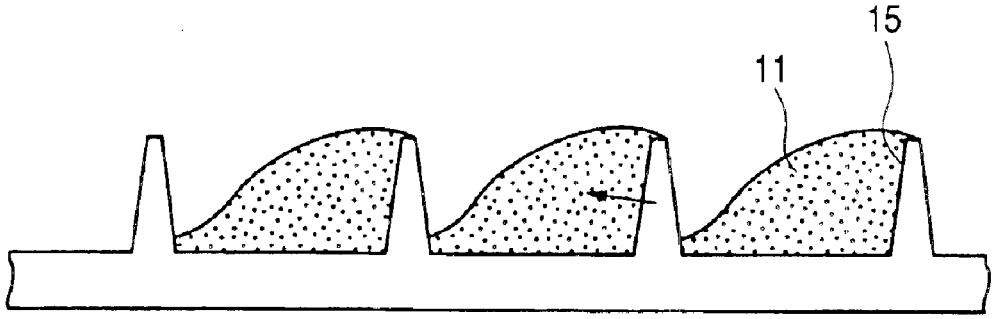

A basic construction of the developer B is the construction shown in the aforementioned FIGS. 7A and 7B except for the screw which is a developer carrying member, the toner replenishing mechanism 9 is provided above a second screw 6, and since toner in an amount corresponding to the consumed toner is dropped and replenished into the developer container 10 via a replenishing port 8, the developer in the developer container 10 is always kept at a fixed toner density.

(Screw Shape)

Next, constructions of the screws 5 and 6 which are developer carrying members of this embodiment will be explained with reference to FIGS. 2A, 2B and 2C. In this embodiment and embodiments that will be described later, shapes of the screws 5 and 6 are the same, but the shape of the screw 6, which is not next to the developing sleeve 2, may not the following shape as long as at least the shape of the screw 5 placed next to the developing sleeve 2 has the construction as shown below in all the embodiments.

In each of the screws 5 and 6 of this embodiment, an outer diameter including a blade 15 is 14 mm, a shaft diameter of a rotary shaft 14 is 6 mm, and a pitch in a longitudinal direction of the blade is 15 mm. While the conventional screw has the construction in which the blade with inclination angles of the carrying surface facing in the developer carrying direction and the surface facing in the opposite direction to the carrying direction with respect to the rotary shaft being the same (a section of the blade is a substantially isosceles triangle) is only wound thereabout in a spiral form, the construction of the screw of this embodiment has a construction in which an angle (inclination angle) θ formed by a carrying surface facing in a developer carrying direction of the blade and a centerline of the rotary shaft 14 is made smaller than the prior art, and inclination angles of the carrying surface facing in the developer carrying direction and a surface facing in an opposite direction to the carrying direction with respect to the rotary shaft differ (the section of the blade is not an isosceles triangle). In concrete, the inclination angle of the carrying surface facing in the developer carrying direction is smaller than the inclination angle of the surface facing in the opposite direction.

Here, when the test of the carrying state of the developer and image formation was performed with the angle θ being changed to several levels with the conditions of the outer diameters of the screws 5 and 6, the pitch and the like being fixed, the results as shown in FIG. 2B were obtained. In the table of FIG. 2B, "○" represents a level which does not appear on an image, "○Δ" represents a level which is insignificant and does not matter, "Δ" represents the lowest passable level, "Δx" represents a level which matters, and "x" represents a very bad level.

From the results of this, the improvement effect in the unevenness of the screw pitch is confirmed by making the angle θ smaller. It is conceivable that this is because, as shown in FIG. 2C, a force exerted to the developer in the perpendicular direction to the rotary shaft 14 increases, and the force pushing in the traveling direction by the blade 15 and the force to be widened in the perpendicular direction are acting on each other, whereby the carrying state of the carried developer is close to the horizontal.

The preferable angle θ for the improving effect for the unevenness of the screw pitch in this case is equal to or smaller than 60 degrees. However, if the aforesaid angle θ is too small, the force for carrying the developer in the carrying direction becomes too small, thereby reducing the carrying performance of the developer, and density reduction due to poor carrying performance easily occurs, which is not preferable. Consequently, it is desirable to set the aforesaid angle θ in the range of $50° \leqq \theta \leqq 60°$.

Since the study of this embodiment was performed with the screw diameter and the pitch being fixed, the above-described results were obtained, and though it is natural that the value of the preferable angle θ varies a little if these forms are changed, the original operational effect of making the carrying state of the developer close to the horizontal as a result that the force by which the developer is pressed in the carrying direction and the force to widen in the perpendicular direction act on each other by changing the angle θ to be smaller than the prior art is not changed.

As explained above, the factors responsible for all the unevenness of the images caused by the screw pitch such as unevenness of supply of the developer 11 to the developing sleeve 2, unevenness of compression at a layer thickness regulating portion following this can be reduced by improving the carrying state of the carried developer to substantially the horizontal by the shape of the screw of this embodiment, and therefore the unevenness of the screw pitch can be improved.

(Second Embodiment)

In the aforementioned first embodiment, the carrying surface facing in the developer carrying direction of the blade of the screw is constructed by a single plane, but in this embodiment, the blade of the screw has "a plurality of carrying surfaces facing in a developer carrying direction and differing in inclination angles with respect to a shaft of a screw". The explanation will be made with reference to FIGS. 3A, 3B and 3C, to FIGS. 5A and 5B.

Figure 4A:
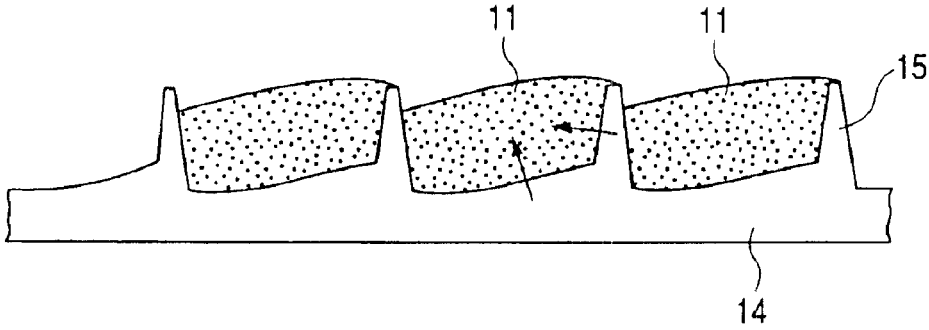
FIG. 4A is an explanatory view of a state of the developer carried by the screw.
Figure 4B:
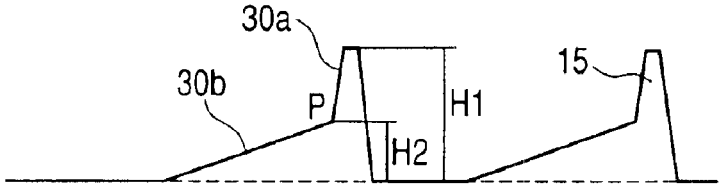
FIG. 4B is a sectional view for explaining relationship of a distance (height) H1 from a plane (reference plane) of a rotational shaft of the screw to a tip end of the blade and a distance H2 from the reference surface to an intersection point P of two surfaces 30*a* and 30*b;*

FIGS. 3A, 3B and 3C show a screw of a developing apparatus according to a second embodiment, FIG. 3A is an outline view of the screw, FIG. 3B is a sectional view cut by a plane passing through a rotation centerline of the screw, and FIG. 3C is a table showing results of performing a developer carrying experiment by changing a blade angle. FIG. 4A is an explanatory view of a state of a developer carried by the screw, and FIG. 4B is a sectional view for explaining relationship of a distance (height) H1 from a surface (reference surface) of a rotary shaft of the screw to a tip end of the blade and a distance H2 from the reference surface to an intersection point P of two carrying surfaces 30*a* and 30*b*.

In each of the screws 5 and 6 according to this embodiment, an outer diameter of the screw including the blade is 14 mm, a shaft diameter of the rotary shaft 14 is 6 mm, and a pitch in a longitudinal direction of the blade is 15 mm, as shown in FIGS. 3A and 3B. The carrying surface facing in the carrying direction of the blade has two surfaces 30*a* and 30*b* having different angles (inclination angles). When the test of confirmation of the carrying state of the developer and image formation was performed by changing an angle θ2 of the surface 30*b* with an angle θ1 of the surface 30*a* being set at 75 degrees, and the distance of the point P at which the two surfaces intersect from the rotary shaft 14 being fixed, the results are as shown in FIG. 3C. The meanings of "○" and "○Δ" in FIG. 3C are the same as in FIG. 2B.

As is obvious from the results, in $10° \leqq \theta 2 \leqq 40°$, the unevenness of the screw pitch hardly appeared on the image, and the favorable results were obtained also in the developer carrying performance of the screw.

This embodiment differs a little from the first embodiment concerning the carrying performance of the developer by the screw, and in the construction of this embodiment, the carrying performance of the developer is not reduced even when the angle θ2 is changed. This is because the force for feeding the developer in the traveling direction is not decreased even if the angle θ2 is changed, since the surface 30*a* farther from the rotary shaft 14 has the larger inclination angle than the surface 30*b* nearer to the rotary shaft 14 and has the higher developer carrying ability in this construction. Consequently, it is found out that the force to widen the developer in the perpendicular direction to the carrying direction can be freely adjusted by properly setting the angle θ2 without reducing the developer carrying performance at all. As a result, an ideal carrying state of the developer in which the unevenness of the screw pitch hardly appears as shown in FIG. 4A can be realized.

The explanation is made with the distance of the point P at which the two surfaces 30*a* and 30*b* intersect each other from the rotary shaft 14 being fixed so far, but the force in the carrying direction of the developer and the force in the perpendicular direction to the shaft can be also adjusted similarly by changing this distance. When a distance (height) from the rotary shaft surface (reference surface) to a tip end of the blade is H1 as shown in FIG. 4B, and a distance from the reference surface to the point P at which the aforesaid two surfaces 30*a* and 30*b* are intersecting each other is H2, a preferable range is $H2 < H1 \times ½$.

Since an area of the carrying surface 30*a* is sharply decreased if the aforesaid distance H2 is set to be longer than this, the carrying performance of the developer is reduced, and the reduction in the entire density in the longitudinal direction of the developing sleeve is easily caused.

When the experiment was performed and the study was made, it was found out that the preferable range of the angle θ2 in the range of $H1 \times ⅓ \leqq H2 \leqq H1 \times ½$ is 3° to 5°, and that it is further desirable to set it at about 5° to 30°.

If the aforesaid angle θ2 is too small (for example, smaller than 3°), the force to widen the developer in the perpendicular direction to the shaft hardly works and the effect of reducing the unevenness of the screw pitch is decreased. If the angle θ2 is too large (for example, larger than 50°), the effect of reducing the unevenness of the screw pitch is decreased.

As explained above, since in this embodiment, the blade of the screw has a plurality of surfaces (two surfaces in this embodiment) facing in the developer carrying direction and differing in their inclination angles with respect to the shaft of the screw, the surface 30*a* farther from the rotary shaft 14 always pushes the developer in the carrying direction as the carrying surface, and the surface 30*b* nearer to the rotary shaft 14 acts to widen the developer from an inside to an outer side in the shaft direction at the same time, thus making it possible to make the carrying state of the developer which is carried horizontal without reducing the carrying performance, and prevent the unevenness of the screw pitch very effectively.

Even if the constructions such as the diameter, the pitch, and the amount of the developer are changed, the carrying state of the developer can be brought into an ideal state, namely, substantially the horizontal comparatively easily by optimizing the angle θ1 of the surface 30*a* farther from the rotary shaft 14, the distance H2 of the point P at which the two surfaces are intersecting each other from the rotary shaft 14, and the angle θ2 of the surface 30*b* nearer to the rotary shaft 14, and thus the unevenness of the screw pitch can be prevented.

Figure 5A:
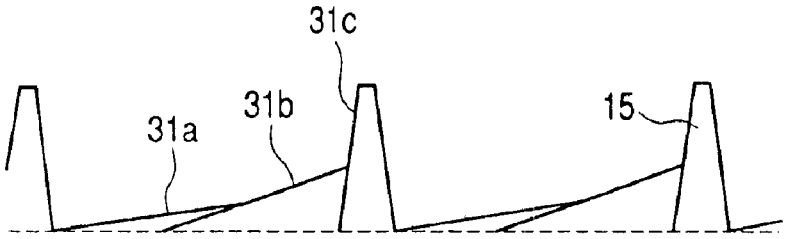
FIG. 5A is an explanatory sectional view of the screw with each one blade having three carrying surfaces with different inclination angles.
Figure 5B:
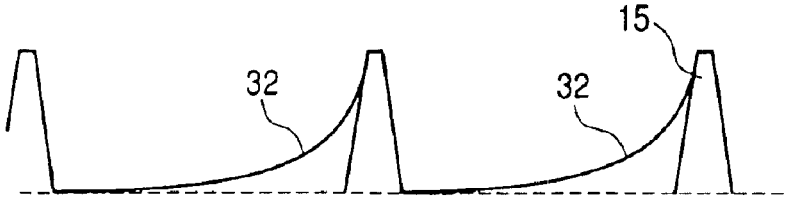
FIG. 5B is an explanatory sectional view of the screw with a base portion of the carrying surface having a curved surface.

Though the case in which the carrying surface is constituted of the two surfaces are explained in this embodiment, the case in which the blade has three surfaces 31*a*, 31*b* and 31*c* or more as shown in FIG. 5A, or the case in which a base portion of the carrying surface facing in the carrying direction is a curved surface 32 and a base portion of the surface at the opposite side from the carrying surface is a non-curved surface as shown in FIG. 5B may be adopted.

In the case of FIG. 5A, an angle θ formed by the farthest surface 31*c* from the rotary shaft 14 and the rotary shaft 14 is made the largest, and an angle θ formed by the surface 31*a* near to the rotary shaft 14 and the rotary shaft 14 is made small, the surface farther from the rotary shaft 14 is worked as the carrying surface and the developer can be widened outwardly from an inside by the nearer surface at the same time as in the case of the construction with the two surfaces, thus easily making a preferable developer carrying state.

In the case of FIG. 5B, it is preferable that the curved surface portion 32 ranges substantially the same area as the pitch of the screw (the space between the adjacent blades) in the developer carrying direction.

It is natural that the surfaces and the angles described in this embodiment indicate the surfaces and their angles acting on the developer dynamically and do not include rounding-off of the tip ends and angles.

(Third Embodiment)

Next, a screw used in a developing apparatus of a third embodiment will be explained. FIG. 9 and FIG. 10 are sectional views each cut by a plane passing through a rotation centerline of the screw of this embodiment, and are the drawings each for explaining angles of the blades and length constituting the blades. A carrying direction of a developer in the drawings is leftward.

The construction of this embodiment is characterized by additionally providing a bulk-increasing spiral blade (a second blade) 16 as a bulk-increasing blade portion just behind the carrying spiral blade 15 (upstream side in a developer carrying direction) in addition to that a carrying spiral blade (first blade) 15 as a carrying blade portion is spirally wound around a shaft of the screw.

As shown in FIG. 9 and FIG. 10, in the carrying spiral blade 15, an angle formed by a carrying surface facing in the developer carrying direction and a centerline of the shaft is (θ1), a height of the blade (a distance from a reference surface of the shaft of the screw) is (H1), and a length in the shaft direction of the blade is (L1), and in the bulk-increasing spiral blade 16, an angle made by a carrying surface facing in the developer carrying direction and the centerline of the shaft is (θ2), a height of the blade is (H2) and a length in the shaft direction of the blade is (L2). An outer diameter of the screw including the blade is assumed to be 14 mm, the diameter of the center shaft member is 6 mm, the pitch in the longitudinal direction of the blade is 15 mm, θ1=70°, H1=4 mm, L1=3 mm, and L2=5 mm.

Figure 12:
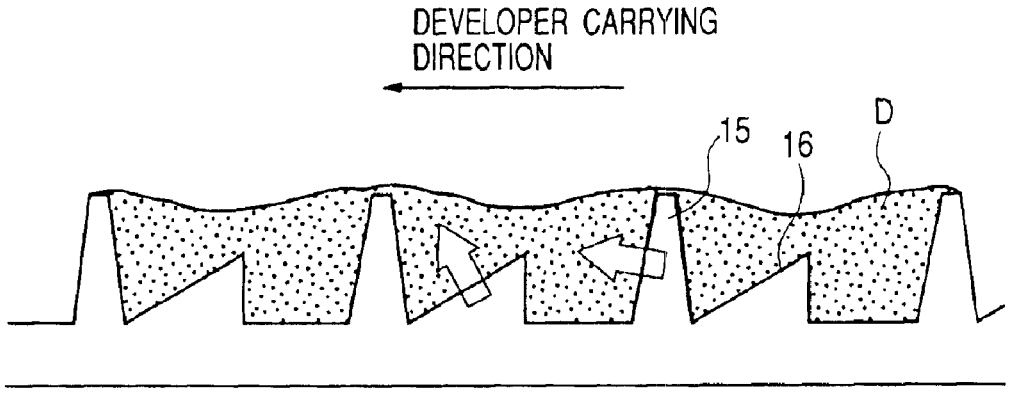
FIG. 12 is a view for explaining an effect of the third embodiment.

The image forming test was performed by changing the height H2 of the bulk-increasing spiral blade 16 to several levels with the conditions of the carrying spiral blade 15 being fixed. The results of this are shown in FIG. 11. The meanings of "○", "Δ" and the like in FIG. 11 are the same as in the case of the first embodiment. From the results, it is confirmed that the unevenness of the screw pitch is improved by adding the bulk-increasing blade 16 to the carrying spiral blade 15. The reason of this will be explained with use of FIG. 12.

In the construction with only the carrying spiral blade 15 as in the conventional art, a clearance tends to occur at a position just behind the carrying spiral blade 15 due to less developer. On the other hand, in this embodiment, the bulk of the developer D is increased by applying a force exerted in the substantially perpendicular direction to the center shaft member 14 to the developer D as a result of adding the bulk-increasing spiral blade 16. As a result that the bulk of the developer D is increased like this, the clearance just behind the carrying spiral blade 15 can be filled. Consequently, it is conceivable that the unevenness of the screw pitch can be effectively prevented.

As shown in FIG. 11, it can be understood that there is a preferable range for the height H2 of the bulk-increasing spiral blade 16, and the effect is reduced if the height H2 is too large or too small. If H2 is too small, the bulk-increasing action of the developer decreases, and therefore the effect of preventing the unevenness of the screw pitch decreases. If H2 is too large, a clearance portion with less developer is also generated just behind the bulk-increasing spiral blade 16, and therefore even if the clearance just behind the carrying spiral blade 15 is filled, a new clearance of the developer is generated.

In consideration of these things, the upper limit of the height of the bulk-increasing spiral blade 16 is preferably within H2<H1×0.7. The optimal angle of θ2 at this time is 5°<θ2<40°, 60°<θ1, more preferably, 10°<θ2<30°, 60°<θ1.

The above-described results were obtained because the study of this embodiment was made with the screw diameter and the pitch being fixed, but if these forms are changed, the values of the preferable angles θ are slightly changed. However, the original operational effect of capable of filling the clearance just behind the carrying spiral blade and effectively preventing the unevenness of the screw pitch by providing the bulk-increasing spiral blade 16 is not changed.

As explained above, in this embodiment, the carrying state of the developer which is carried is improved to the substantially horizontal by providing the bulk-increasing spiral blade 16 just behind the carrying spiral blade 15 (the second blade is adjacent to the first blade at the upstream side in the developer carrying direction). As a result, the factors of generating all the unevenness of the image caused by the screw pitch, such as the unevenness of supply of the developer D to the developing sleeve 2, unevenness of compression at a developer layer thickness regulating portion in the developer sleeve form following this, and the difference in the toner density of the developer D carried by the screw and the developer after developing which is returned from the developing sleeve 2 by extension can be reduced. Thus, the image with the unevenness of the screw pitch can be improved.

(Fourth Embodiment)

Figure 13:
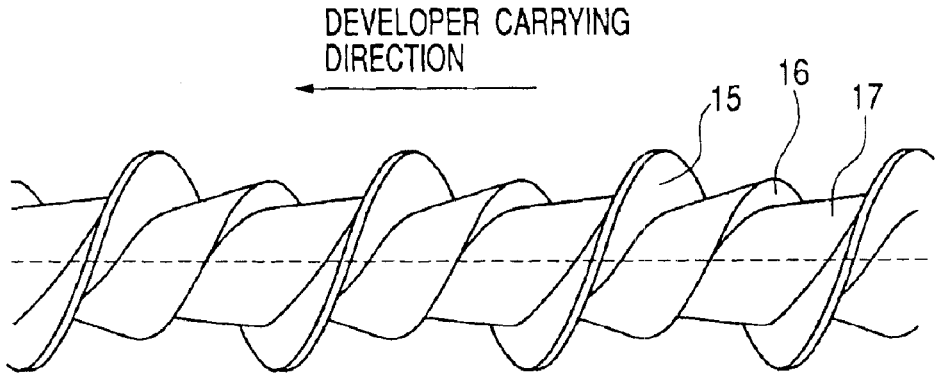
FIG. 13 is an outline view of a screw of a fourth embodiment.
Figure 14:
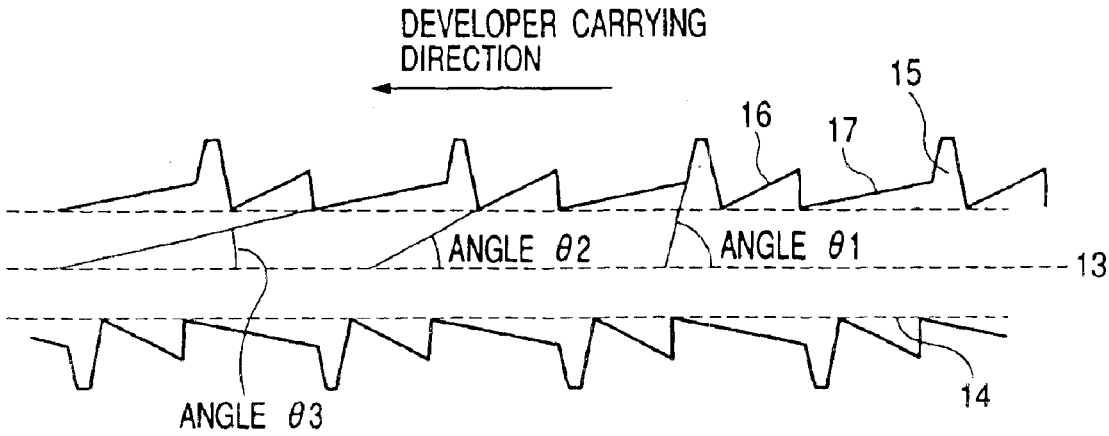
FIG. 14 is a sectional view cut by a plane passing through a rotation centerline of the screw of the fourth embodiment.

In the third embodiment, the construction which is additionally provided with one bulk-increasing spiral blade 16 just behind the carrying spiral blade 15 is explained, but in this embodiment, a construction provided with two bulk-increasing spiral blades by adding one more bulk-increasing spiral blade will be explained. Looking at this from a different angle, the construction in which a surface 17 of a space between a second blade 16 and "a first blade 15 at an upstream side of the second blade 16 in the developer carrying direction" is inclined to the developer carrying direction is adopted. FIG. 13 is an outline view of a screw of this embodiment, FIG. 14 and FIG. 15 are sectional views each cut by a plane passing through a rotation centerline of the screw of this embodiment, which are views for explaining angles of the blades and lengths constructing the blades. The carrying direction of the developer in these drawings is leftward.

An outer diameter of the screw including the blade is 14 mm, a diameter of the center shaft member is 6 mm, a pitch in a longitudinal direction of the blade is 15 mm, θ1=70°, H1=4 mm, and L1=3 mm. As for the bulk-increasing spiral blade 16, H2=2 mm, and L2=5 mm as described in the third embodiment.

In this state, the bulk-increasing spiral blade (surface of the space) is placed just behind the bulk-increasing spiral blade 16 of the third embodiment as an additional bulk-increasing blade. Since a surface of the bulk-increasing spiral blade 17 newly provided in the fourth embodiment, which faces in the carrying direction, is located at a position very close to the blade surface of the carrying spiral blade 15 in the carrying direction, the blade surfaces of both of them in the carrying direction are connected at a point P (see FIG. 15), and two surfaces with different inclination angles are provided at the blade 15 as in the first embodiment, whereby the shape in which the inclined surface 17 is added to the shape of the screw of the third embodiment in appearance is made. Under this condition, the effect for the unevenness of the screw pitch and the developer carrying performance was studied by changing a height H3 to several levels to change the angle of the bulk-increasing blade 17. The results of this are shown in FIG. 16. From the results of this, it can be confirmed that the unevenness of the screw pitch is improved by adding the bulk-increasing spiral blade 17. The reason of this will be explained with use of FIG. 17.

As shown in FIG. 17, in this embodiment, as a result of providing the bulk-increasing blade 17, not only the clearance of the developer just behind the carrying spiral blade 15 can be filled as in the third embodiment, but also a force exerted in substantially the perpendicular direction to the rotation centerline can be applied to the developer in a middle point of the carrying spiral blade 15 and the carrying spiral blade 16 where the developer height tends to be low. As a result, it is made possible to realize the extremely even developer height as a whole. Since only the virtual bulk of the developer is increased and the carrying amount is not decreased, the developer carrying performance is not hindered as long as this is used in a preferable range.

As shown in FIG. 16, it is understood that there is a preferable range for the height H3 of the bulk-increasing blade 17, namely, an angle θ3 (corresponding to θ2 in the first embodiment) and if it is too large or too small, the effect is reduced. If H3 is too small, the bulk-increasing action of the developer becomes small, and therefore the effect of preventing the unevenness of the screw pitch becomes small. If H3 is too large, an effective area of the carrying spiral blade 15 located just behind the bulk-increasing spiral blade 17 becomes too small to reduce the developer carrying performance, and reduction in density is easily caused.

In consideration of these things, the preferable range of the bulk-increasing blade 17 is H3<H1×0.5. The optimal angle of θ3 at this time is 5°<θ3<40°, more preferably, 10°<θ3<30°.

As explained above, in this embodiment, as a result of providing two of the bulk-increasing spiral blades (looking at this from a different angle, the construction in which the surface 17 between the second blade 16 and "the first blade 15 at the upstream side of the second blade 16 in the developer carrying direction" is inclined to the developer carrying direction is adopted), not only the clearance just behind the carrying spiral blade (the first blade) 15 can be filled as in the third embodiment, but also the force exerted in the perpendicular direction to the rotation centerline is applied to the developer in the middle point between the carrying spiral blade and the carrying spiral blade, where the height of the developer tends to be low, whereby it is possible to realize extremely uniform developer height as a whole.

As a result, the factors, which generate all the image unevenness caused by the screw pitch, such as the unevenness of supply of the developer to the developing sleeve, the unevenness of compression at the regulating portion following this, and the difference in the toner density of the developer carried by the screw and the developer after developing which is returned from the developing sleeve, can be reduced, and therefore the image with the unevenness of the screw pitch can be improved.

Figure 18:
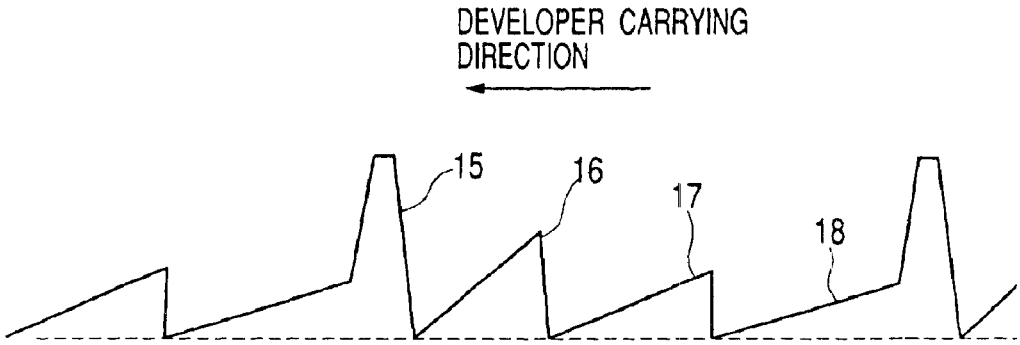
FIG. 18 is a sectional view showing a modification example of the fourth embodiment.

The case in which two of the bulk-increasing spiral blades are included is explained so far, but the bulk-increasing spiral blade may be constructed by three or more bulk-increasing spiral blades as a bulk-increasing blade part (here, a bulk-increasing blade 18 is added) as shown in FIG. 18, or more bulk-increasing spiral blades than this. By placing a plurality of bulk-increasing spiral blades in addition to the carrying spiral blade, the center shaft member is covered with the carrying spiral blades and the bulk-increasing spiral blades, and most of the screw is constructed by the surfaces inclined in the carrying direction without exposing substantially all parts of the center shaft member. As a result, it becomes possible to allow the force in the carrying direction and the force exerted in the perpendicular direction to the rotation centerline to act on the developer existing all the places of the screw, thus making it possible to keep the developer height uniform.

Since the study of this embodiment was made with the screw diameter and the pitch being fixed, the above-described results were obtained, but if these forms are changed, the values of the preferable angles θ also vary a little. However, the clearance just behind the carrying spiral blade and the clearance at the middle point between the carrying spiral blade and the carrying spiral blade can be filled by providing the bulk-increasing spiral blades which are the characteristic of the present invention, and therefore the original operational effect of being capable of effectively preventing the unevenness of the screw pitch is not changed.

Figure 6:
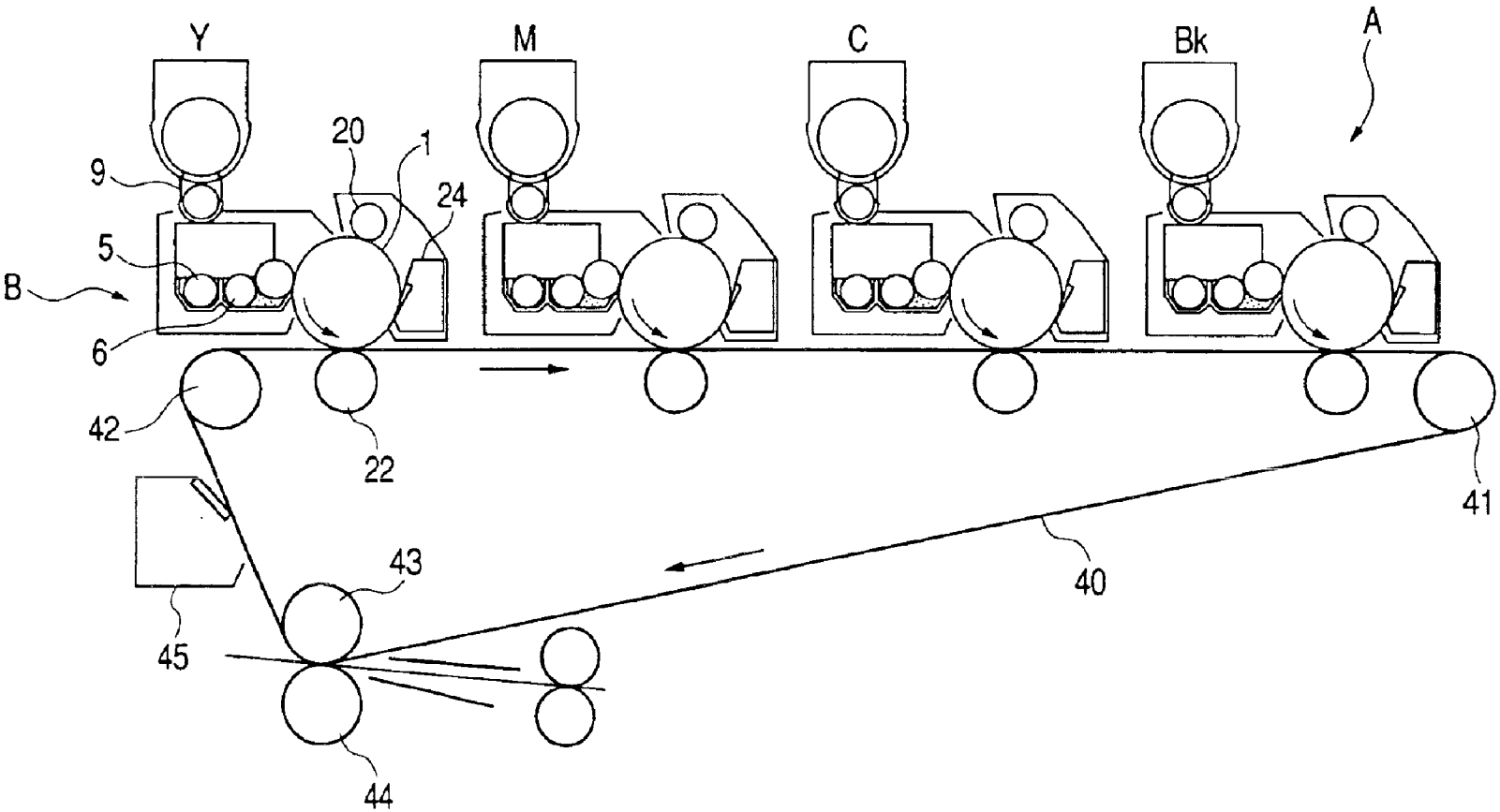
FIG. 6 is a schematic explanatory view of a four-drum type printer which provides a full-color print image.

FIG. 6 is a sectional view of a full-color printer to which the developers of the aforementioned embodiments 1 to 4 are applicable.

FIG. 6 shows a schematic explanatory view of a four-drum type (inline) printer which continuously performs multiple transference of an image developed on four latent image bearers to an intermediate transferring belt 40 being a second image bearer temporarily, and provides a full-color print image.

In FIG. 6, the intermediate transferring belt 40 in the endless form is looped over a driving roller 41, a tension roller 42 and a secondary transferring opposed roller 43, and is rotated in the direction of the arrows in the drawing.

A photosensitive member drum 1 for developing a yellow toner is uniformly electrified to have predetermined polarity and potential by an electrifying roller 20 in its rotation process, and is subsequently subjected to image exposure by image exposing means not shown (an optical system of color separation of a color copy image and image formation exposure, a scanning exposure system by laser scan outputting a laser beam modulated correspondingly to a time series electric digital pixel signal of image information, and the like), whereby an electrostatic latent image corresponding to a yellow component image of an intended color image is formed.

Next, the electrostatic latent image is developed by the developing apparatus B (yellow developing apparatus), and thereafter it is transferred onto the intermediate transferring belt 40.

Four of the above-described image forming units are provided in the order of yellow Y, magenta M, cyan C, and black Bk, and by them, images of yellow, magenta, cyan and black are overlaid on the intermediate transferring member 40, whereby a full-color image is formed.

The four full-color image formed on the intermediate transferring belt 40 are then collectively transferred to a transferring material by a secondary transferring roller 44, and the color pint image fused and fixed by a fixing apparatus not shown is provided.

A residual secondary transferring toner remaining on the intermediate transferring belt 40 is subjected to blade cleaning with an intermediate transferring belt cleaner 45 to prepare for the next image forming process.

In such a color image forming apparatus, unevenness of the fixed pitch such as unevenness of the screw pitch is amplified due to superposing of colors and tends to stand out. However, if the screw structure with the construction of the aforementioned embodiments is used as at least the screw placed adjacently to the developing sleeve of the developing apparatus B, it is very effective to prevent unevenness of the screw pitch, and a large effect is exhibited.

The developing apparatus B in each of the embodiments is not only included in the image forming apparatus, but also may be constructed as a developing unit detachably attachable to the main body of the image forming apparatus.

Further, in a unitized photosensitive member drum 1 as an image bearer and the developing apparatus B, or a process cartridge, which unitizes the photosensitive member drum 1 and the developing apparatus B, and process means for forming an image by an electrophotographic image forming process, for example, an electrifier device 20, a cleaning device 24 and the like, and which is made detachably attachable to the main body of the image forming apparatus, the unevenness of the screw pitch can be also prevented by constructing the developing apparatus as in each of the embodiments, which is favorable.

Since the present invention is constructed as described above, the developer is carried in the substantially horizontal state by the screw, and therefore the developer supplied to the developer carrying member does not form portions with a large amount and portions with a small amount in the longitudinal direction, thus making it possible to prevent the unevenness of the screw pitch effectively.

The present invention is not limited to the aforementioned embodiments, but includes various modifications within the scope of the technical idea.

What is claimed is:

1. A developing apparatus comprising:

a developer bearing member; and a developer carrying screw placed in parallel with said developer bearing member, wherein said developer carrying screw includes a rotary shaft and a spiral blade, and said spiral blade is wound about said rotary shaft in a spiral form and has a carrying surface for carrying developer, and wherein when viewing said developer carrying screw in cross section along a longitudinal direction of said developer carrying screw, an inclination angle with respect to a rotation centerline of said rotary shaft at said carrying surface is smaller than an inclination angle with respect to the rotation centerline of at an opposite side of said carrying surface.

2. The developing apparatus according to claim 1, wherein said developer carrying screw is placed adjacently to said developer bearing member.

3. The developing apparatus according to claim 1, wherein the inclination angle of the carrying surface is equal to or more than 50 degrees and equal to or less than 60 degrees.

4. A developing apparatus comprising:

a developer bearing member; and a developer carrying screw placed in parallel with said developer bearing member, wherein said developer carrying screw includes a rotary shaft and a spiral blade, and said spiral blade is wound about said rotary shaft in a spiral form and has a carrying surface for carrying a developer, and wherein when viewing said developer carrying screw in cross section along a longitudinal direction of said developer carrying screw, said carrying surface includes surface portions having a plurality of different inclination angles with respect to a rotation center line of said rotary shaft.

5. The developing apparatus according to claim 4, wherein said surface portions include a portion of said carrying surface near to said rotary shaft and a portion of said carrying surface farther from said rotary shaft, and wherein said portion of said carrying surface near to said rotary shaft has a smaller angle than said portion of said carrying surface farther from said rotary shaft.

6. The developing apparatus according to claim 5, wherein an inclination angle of said portion of said carrying surface near to said rotary shaft is equal to or more than 3 degrees and equal to or less than 50 degrees.

7. The developing apparatus according to claim 4, wherein when a distance from a reference surface of said rotary shaft to a tip end of said blade is H1, and a distance from the reference surface to a point P at which the surface portions intersect each other is H2, $H2<H1\times\frac{1}{2}$ is satisfied.

8. The developing apparatus according to claim 7, wherein $H1\times\frac{1}{3}<H2<H1\times\frac{1}{2}$ is satisfied.

9. The developing apparatus according to claim 4, wherein said developer carrying screw is placed adjacently to said developer bearing member.

10. The developing apparatus according to claim 4, wherein the carrying surface is a curved surface.

11. A developing apparatus comprising:

a developer bearing member; and a developer carrying screw placed in parallel with said developer bearing member, wherein said developer carrying screw includes a rotary shaft and a plurality of spiral blades, and each of said plurality of blades is wound about said rotary shaft in a spiral form and has a carrying surface for carrying a developer, and wherein when viewing said developer carrying screw in cross section along a longitudinal direction of said developer carrying screw, an inclination angle of a carrying surface of one of said plurality of blades with respect to a rotation centerline of said rotary shaft is different from an inclination angle of a carrying surface of the other of said plurality of blades.

12. The developing apparatus according to claim 11, wherein each of said plurality of said developer carrying screws includes a first blade with an inclination angle of a carrying surface having a first value, and a second blade with an inclination angle of a carrying surface having a second value smaller than the first value, and said second blade is adjacent to said first blade, at an upstream side in a developer carrying direction.

13. The developing apparatus according to claim 12, wherein when a distance from a reference surface of said rotary shaft to a tip end of said first blade is H1, and a distance from the reference surface to a tip end of said second blade is H2, $H2<H1\times\frac{1}{2}$ is satisfied.

14. The developing apparatus according to claim 13, wherein an inclination angle of said first blade is larger than 60 degrees, and an inclination angle of said second blade is larger than 5 degrees and smaller than 40 degrees.

15. The developing apparatus according to claim 12, wherein a surface in a space between said second blade and said first blade at an upstream side of said second blade in a developer carrying direction is inclined with respect to the developer carrying direction.

16. The developing apparatus according to claim 15, wherein when a distance from a reference surface of said rotary shaft to a tip end of said first blade is H1, and a distance from the reference surface to a point P at which the carrying surface of said first blade and the surface in the space are intersecting each other is H3, $H3<H1\times\frac{1}{2}$ is satisfied.

17. The developing apparatus according to claim 16, wherein an inclination angle of the surface in the space is larger than 5 degrees and smaller than 40 degrees.

18. The developing apparatus according to claim 11, wherein said developer carrying screw is placed adjacently to said developer bearing member.

* * * * *

UNITED STATES PATENT AND TRADEMARK OFFICE

CERTIFICATE OF CORRECTION

PATENT NO. : 7,035,573 B2
APPLICATION NO. : 10/664960
DATED : April 25, 2006
INVENTOR(S) : Seiji Yamaguchi et al.

It is certified that error appears in the above-identified patent and that said Letters Patent is hereby corrected as shown below:

ON THE TITLE PAGE

At Item (56), Foreign Patent Documents, "JP 2002278270 A 9/2002" should read --JP 2002-278270 A 9/2002--; and "JP 09325609 A 12/1997" should read --JP 93-25609 A 12/1997--.

COLUMN 1

Line 41, "carries" should read --carry--.

COLUMN 2

Line 5, "force-for" should read --force for--; and
Line 16, "Consequently, as viewed" should read --Consequently, as viewed in--; and
Line 17, "developer 11" should read --developer 11,--.

COLUMN 3

Line 66, "relationship" should read --the relationship--.

COLUMN 5

Line 9, "in the order" should read --in that order--; and
Line 50, "may not the following" should read --may not be the below-described--.

COLUMN 6

Line 4, "In concrete," should read --Specifically,--.

COLUMN 7

Line 5, "relationship" should read --the relationship--; and
Line 64, "$H1\times1/3\leq H2\leq H1\times½$" should read --$H1\times1/3<H2<H1\times½$--.

COLUMN 8

Line 29, "are explained" should read --is explained--; and
Line 65, "direction) in addition to that a" should read --direction). In addition to that, a--.

COLUMN 9

Line 23, "of this" should read --for this--; and
Line 56, "of capable" should read --is capable--.

COLUMN 11

Line 51, "existing" should read --existing in--.

UNITED STATES PATENT AND TRADEMARK OFFICE

CERTIFICATE OF CORRECTION

PATENT NO. : 7,035,573 B2
APPLICATION NO. : 10/664960
DATED : April 25, 2006
INVENTOR(S) : Seiji Yamaguchi et al.

It is certified that error appears in the above-identified patent and that said Letters Patent is hereby corrected as shown below:

COLUMN 12

Line 32, “image” should read --images--; and
Line 35, “pint image” should read --print image--.

COLUMN 13

Line 21, “of at an” should read --at an--.

Signed and Sealed this

Tenth Day of October, 2006

JON W. DUDAS
*Director of the United States Patent and Trademark Office*